US010479040B2

(12) United States Patent
Honegger et al.

(10) Patent No.: US 10,479,040 B2
(45) Date of Patent: Nov. 19, 2019

(54) DEVICE AND METHOD FOR CONTROLLING THE PRIMARY DRIVE OF A FINE BLANKING PRESS

(71) Applicant: Feintool International Holding AG, Lyss (CH)

(72) Inventors: Hans-Ruedi Honegger, Wolfhausen (CH); Andreas Walther, Laupen (CH); Alex Wehrli, Kehrsatz (CH)

(73) Assignee: Feintool International Holding AG, Lyss (CH)

( * ) Notice: Subject to any disclaimer, the term of this patent is extended or adjusted under 35 U.S.C. 154(b) by 704 days.

(21) Appl. No.: 15/203,463

(22) Filed: Jul. 6, 2016

(65) Prior Publication Data

US 2017/0120551 A1 May 4, 2017

(30) Foreign Application Priority Data

Jul. 6, 2015 (EP) ..... 15002015

(51) Int. Cl.
*B30B 15/16* (2006.01)
*B30B 1/32* (2006.01)
*B21D 22/02* (2006.01)

(52) U.S. Cl.
CPC ..... *B30B 15/161* (2013.01); *B21D 22/02* (2013.01); *B30B 1/32* (2013.01); *B30B 15/16* (2013.01); *B30B 15/163* (2013.01)

(58) Field of Classification Search
CPC ..... B30B 15/041; B30B 15/16; B30B 15/161; B30B 1/32; B30B 15/163; B21D 28/00; B21D 28/002; B21D 28/16; B21D 22/02
USPC ..... 100/269.1
See application file for complete search history.

(56) References Cited

U.S. PATENT DOCUMENTS

| | | | | |
|---|---|---|---|---|
| 5,247,862 | A * | 9/1993 | Haack | B21D 28/16 83/124 |
| 5,460,084 | A | 10/1995 | Otremba et al. | |
| 5,749,279 | A * | 5/1998 | Gardner | B21D 28/002 83/639.1 |
| 5,852,933 | A * | 12/1998 | Schmidt | B30B 15/16 60/413 |
| 6,240,818 | B1 | 6/2001 | Baltschum | |
| 6,550,241 | B2 * | 4/2003 | Ostini | B21D 28/00 60/433 |
| 6,964,225 | B2 * | 11/2005 | Gubler | B30B 15/041 100/214 |
| 2003/0047202 | A1 | 3/2003 | Worm | |
| 2004/0094048 | A1 | 5/2004 | Yamanaka et al. | |

FOREIGN PATENT DOCUMENTS

| | | | |
|---|---|---|---|
| CN | 1585999 | A | 2/2005 |
| CN | 204321151 | U | 5/2015 |
| DE | 2218476 | A1 | 9/1973 |
| DE | 2264429 | A1 | 9/1973 |
| DE | 19524042 | A1 | 3/1996 |

(Continued)

*Primary Examiner* — David B Jones
(74) *Attorney, Agent, or Firm* — Norris McLaughlin, P.A.

(57) ABSTRACT

In an apparatus and a method for controlling the primary drive of a hydraulically driven fine blanking press, the hydraulic circuit is simplified due to the elimination of hydraulic tubes, and the amount of hydraulic fluid is reduced, while increasing the number of strokes and achieving a simple design for the press.

12 Claims, 10 Drawing Sheets

SECTION A-A

(56) References Cited

FOREIGN PATENT DOCUMENTS

| | | | |
|---|---|---|---|
| DE | 19642635 | A1 | 10/1997 |
| DE | 19741879 | A1 | 3/1999 |
| DE | 19822436 | A1 | 10/1999 |
| DE | 10215003 | A1 | 8/2003 |
| DE | 102004006126 | B4 | 12/2006 |
| DE | 102009058407 | A1 | 6/2011 |
| DE | 102012006981 | A1 | 10/2013 |
| EP | 0311779 | B1 | 10/1993 |
| EP | 0615837 | B1 | 5/1997 |
| EP | 0891235 | B1 | 10/2003 |
| EP | 1420169 | A2 | 5/2004 |
| GB | 2271149 | A | 4/1994 |

* cited by examiner

SECTION A-A

SECTION B-B

SECTION C-C

DEVICE AND METHOD FOR CONTROLLING THE PRIMARY DRIVE OF A FINE BLANKING PRESS

BACKGROUND OF THE INVENTION

The invention relates to a device for controlling the primary drive of a hydraulically driven fine blanking press, comprising a main cylinder, which is disposed in the base and in which the main piston/ram is guided, which can be acted on by hydraulic fluid via pressure chambers, carries out a stroke movement between BDC and TDC in the direction of the stroke axis and supports a table, further comprising double-acting fast stroke pistons, which are guided in fast stroke cylinders, can be acted on by hydraulic fluid via pressure chambers, and include piston rods for the rapid approach/probe stroke of the main piston and the table plate, and a hydraulic system, which includes at least one hydraulic pump unit, for supplying the pressure chambers with the hydraulic fluid that is set by a central control unit to a predefined working pressure.

The invention further relates to a method for controlling the primary drive of a hydraulically driven fine blanking press, comprising a main piston, which is guided in a main cylinder of the base, supports a table, and carries out a stroke movement between the lower dead point UT and and the upper dead point OT, in which the main piston, together with the table, is displaced in the rapid approach/probe stroke between UT and OT, or OT and UT, by pressurization of the pressure chambers of a fast stroke piston disposed in the fast stroke cylinder, the rapid motion/probe stroke is then ended, and subsequently the main piston, during the power stroke, carries out the blanking or forming operation, wherein the pressure chambers of the main piston are acted on by a working pressure of a hydraulic fluid from a hydraulic system which is predefined by a central control unit and generated by a hydraulic pump unit.

The fine blanking process requires specific triple-action presses, which essentially operate from the bottom to the top and enable a controlled regulation of the blanking operation, including the auxiliary functions for the vee ring, pressure pad and ejector. The vee ring force and the counter force are generated hydraulically, and the blanking force is generated mechanically or hydraulically.

A number of piston arrangements exist, which are used in presses for driving or pressurization purposes. The prior art according to DE 2 218 476 A1 and DE 2 264 429 A1 relates to a fine blanking press comprising two rigidly connected frame parts, on which two table bodies are arranged, which are used to clamp on two tool parts and which can be displaced by hydraulic means axially toward and away from each other. A cylindrical chamber is provided in the first frame part and receives therein two pistons movable coaxially relative to each other, with the first piston being connected to a piston rod and the second surrounding this piston rod and forming part of the first table body arranged displaceably on the first frame part. The second piston has a female thread and is screwed to a bushing having a male thread, so that the axial position of the second piston can be set.

From DE 195 24 042, a method for regulating the drive is known, in particular for a hydraulic press for forming and/or cutting metal sheets, comprising at least one double-acting piston-cylinder unit for driving a press ram. This press operates in the direction of gravity, which is to say from top to bottom. During a first working phase of the press, the top and bottom cylinder chambers of the piston-cylinder unit are connected via a valve system during the downward motion of the unloaded press ram. A motor/pump system comprising a volume-controlled hydraulic motor/pump system is provided for the subsequent forming phase, the system being driven at least via a chargeable accumulator system, and the regulatable torque can be supplied to a regulatable pump system.

DE 198 22 436 A1 describes a method for operating a hydraulic press, in which the force required for deforming a workpiece is created by the piston of a double-acting cylinder, and this force is transmitted via mechanical intermediate members from the piston to a press tool, wherein the press tool impinges on the workpiece only after the press tool has traversed a first length of travel, and forming then takes place while a second length of travel is being traversed. The press operates from top to bottom, and the rapid approach is essentially caused by the inherent weight of the press crosshead when the pressure is relieved.

DE 10 2012 006 981 A1 discloses a hydraulic press comprising a ram, which can be adjusted by way of a hydraulic drive device, wherein the hydraulic drive device comprises a working cylinder in which a drive piston is displaceably received, which divides the interior of the drive cylinder into a first working chamber and a second working chamber, which can be acted on by a hydraulic fluid. At least one hydraulic return device is provided so as to bring the ram into the starting position thereof after the forming process.

The basic idea of this known prior art is to discharge the hydraulic fluid during the forming process from the second working chamber via a pump into the storage tank.

Providing rapid approach cylinders during the advance stroke of the press ram are known from a number of solutions (DE 196 43 635 A1, DE 197 41 879 A1, DE 198 22 436 A1, DE 102 15 003 A1, DE 10 2004 006 126 B4, DE 10 2009 058 407 A1, EP 0 311 779 B1, EP 0 615 837 B1, EP 891 235 B1.)

In all these known solutions, the main piston and the rapid approach piston belong to separate hydraulic circuits, in which the hydraulic fluid displaced from the working chambers is either discharged during the downward motion of the pistons into a tank ((DE 10 2009 058 407A1), or shifted from the top working chamber into the bottom working chamber (DE 10 2004 006 126 B4, DE 196 42 635 A1, DE 102 15 003 A1, EP 0 891 235 B1).

This shifting is carried out in separately routed hydraulic tubes, and independently of the position of the fast stroke piston in the fast stroke cylinder. The fast stroke cylinders are generally disposed on the head piece of the press and must therefore be able to support the entire top structure of the press, including the traverse member, and lift it during the advance stroke. The primary drive/ram of these known presses is not equipped with a rapid approach function or fast stroke cylinder, so that the cycle time or the achievable number of strokes is accordingly low.

SUMMARY OF THE INVENTION

With this prior art, it is the object of the invention to create a device and a method for controlling the primary drive of a hydraulically driven fine blanking press, the hydraulic circuit of which is simplified due to the elimination of hydraulic tubes, and with which the amount of hydraulic fluid can be reduced, while increasing the number of strokes and achieving a simple design for the press.

The solution according to the invention is based on the finding of displacing the hydraulic fluid that is present in the pressure chambers of the main piston during the rapid approach/probe stroke from one pressure chamber into the other pressure chamber of the main piston during the advance in the stroke direction of the fast stroke pistons.

This is achieved in that the main piston comprises disk-like protruding working surfaces, which in the main cylinder chamber are located on top of one another, partitioning the first (top) and second (bottom) pressure chambers with a low stroke, with which first (top) fluid channels and second (bottom) fluid channels are associated in the base, which are connected to the hydraulic system, wherein the first fluid channels are connected to the second fluid channels by a respective bypass channel disposed in the base, the bypass channel together with these channels and the pressure chambers forming an inner hydraulic system, which during the rapid approach is opened by pressure-controlled proportional valves during displacement of the hydraulic fluid from the first pressure chamber into the second pressure chamber, and closed during the power stroke, and in that, during the power stroke, at least one second fluid channel is a power stroke channel, the first pressure chamber is connected to a vent channel, wherein this fluid channel is connected to a supply channel and branch channel for supplying hydraulic fluid having a predefined pressure into the second pressure chamber, and the vent channel is connected to a collection tank for discharging the hydraulic fluid that is displaced from the first pressure chamber via a tank valve.

According to a further preferred embodiment of the device according to the invention, it is provided that, during the power stroke, the second pressure chamber of the main piston is connected to the hydraulic pump unit via a safety valve, at least one pressure pick-up for pressure detection, at least one pressure control valve for limiting the pressure of the delivery flow, and a proportional valve for setting the delivery volume.

In a further preferred embodiment of the device according to the invention, the main piston can have identical or differently sized working surfaces, whereby both constant velocity pistons and other pistons can be used, depending on the application.

It is also advantageous when the proportional valves and the tank valve are pressure-controlled built-in valves.

A further preferred embodiment of the device according to the invention provides for the fast stroke piston to partition pressure chambers having differently sized effective surfaces in the fast stroke cylinder, which are connected via channels provided in the base to the hydraulic system, wherein the pressure chamber having the larger effective surface is integrated into a hydraulic branch composed of a double check valve, a 4/3-way proportional valve, a controllable proportional valve, and a high pressure accumulator, and the pressure chamber having the smaller effective surface is connected via the 4/3-way proportional valve to the collection tank.

The differently sized effective surfaces on the fast stroke piston make it possible to carry out the rapid approach in the upward and downward directions at differing speeds.

Advantageously, the larger effective surface of the fast stroke piston is associated with the upward motion.

It has proven advantageous to accommodate two opposing fast stroke cylinders oriented parallel to the stroke axis in the base, the piston rods of the cylinders being connected to a respective carrier, which are each attached to one side of the table.

On the upper face of the base, the fast stroke cylinders are closed in a pressure-tight manner by a respective cover, so that easy installation and accessibility are ensured.

It is also advantageous that a displacement measuring unit for detecting the TDC position of the main piston is associated with the main piston, and the tank valve for building a counter force for reducing the cutting impact is associated with the first pressure chamber of the main piston.

According to a preferred embodiment of the invention, the hydraulic pump unit comprises at least one proportional valve for setting the delivery volume, at least one pressure pick-up for activating the proportional valve, and at least one pressure control valve for limiting the pressure and maintaining the delivery flow.

The object of the invention is further achieved by a method in which the pressure chambers of the fast stroke piston during the rapid approach/probe stroke are fed from a high pressure accumulator that is permanently set to the working pressure, and at the same time, the pressure chambers of the main piston are separated from the hydraulic system and connected via fluid channels and bypass channels, so that the hydraulic fluid is displaced from the first pressure chamber into the second pressure chamber in a substantially depressurized state in the stroke direction of the fast stroke piston during the rapid approach.

It is of essential significance for the control of the pressure chambers of the fast stroke piston that the working pressure in the pressure chamber of the fast stroke piston having the larger effective surface is set by the central control unit via a double check valve, a 4/3-way proportional valve, a controllable proportional valve, and a high pressure accumulator, and the working pressure in the pressure chamber of the fast stroke piston having the smaller effective surface is set via the 4/3-way proportional valve.

In a further embodiment of the method according to the invention, during the power stroke, the working pressure in the bottom pressure chamber of the main piston is set by the central control unit via an activatable proportional valve, at least one pressure pick-up for pressure detection, at least one pressure control valve for limiting the pressure of the delivery flow, and a proportional valve for the delivery volume and the hydraulic pump unit, and the working pressure in the first pressure chamber is set via the proportional valve.

It is particularly advantageous that the OT position of the main piston is set by the central control unit via a displacement measuring system, wherein the delivery volume of the hydraulic pump unit is reduced before OT is reached, or a counter pressure is generated by the tank valve in the first pressure chamber.

Further advantages and details will be apparent from the following description with reference to the accompanying drawings.

The invention will be described in more detail hereafter based on one embodiment.

In the drawings:

DETAILED DESCRIPTION OF THE INVENTION

Figure 1:
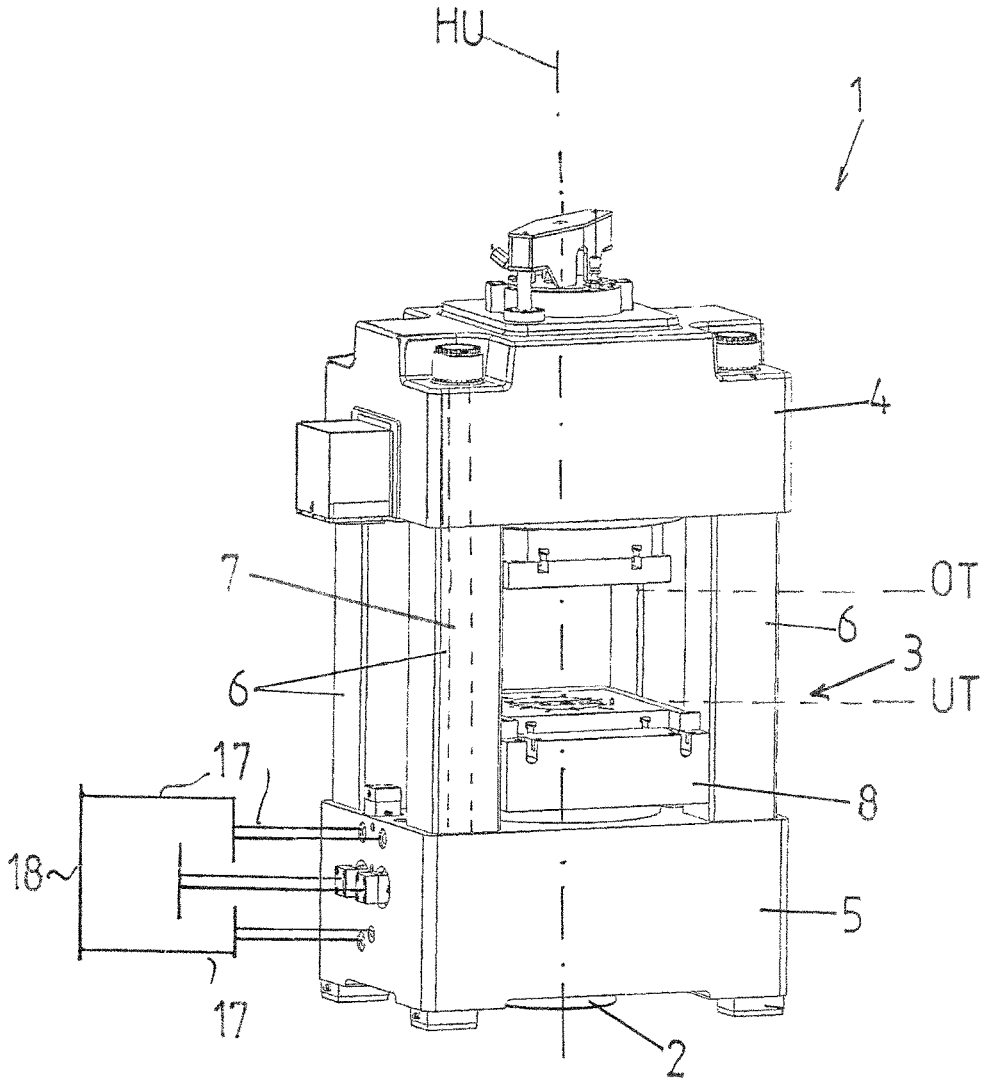
FIG. 1 shows a perspective view of a fine blanking press connected to the hydraulic system.

FIG. 1 shows a perspective representation of a hydraulically driven fine blanking press 1, the main piston 2 of which essentially carries out a stroke movement between a lower dead point and an upper dead point OT in the direction of the stroke axis HU from the bottom to the top. The body 3 of the press 1 comprises a head piece 4, a base 5, box-shaped hollow pillars 6, and tie rods 7.

Figure 2:
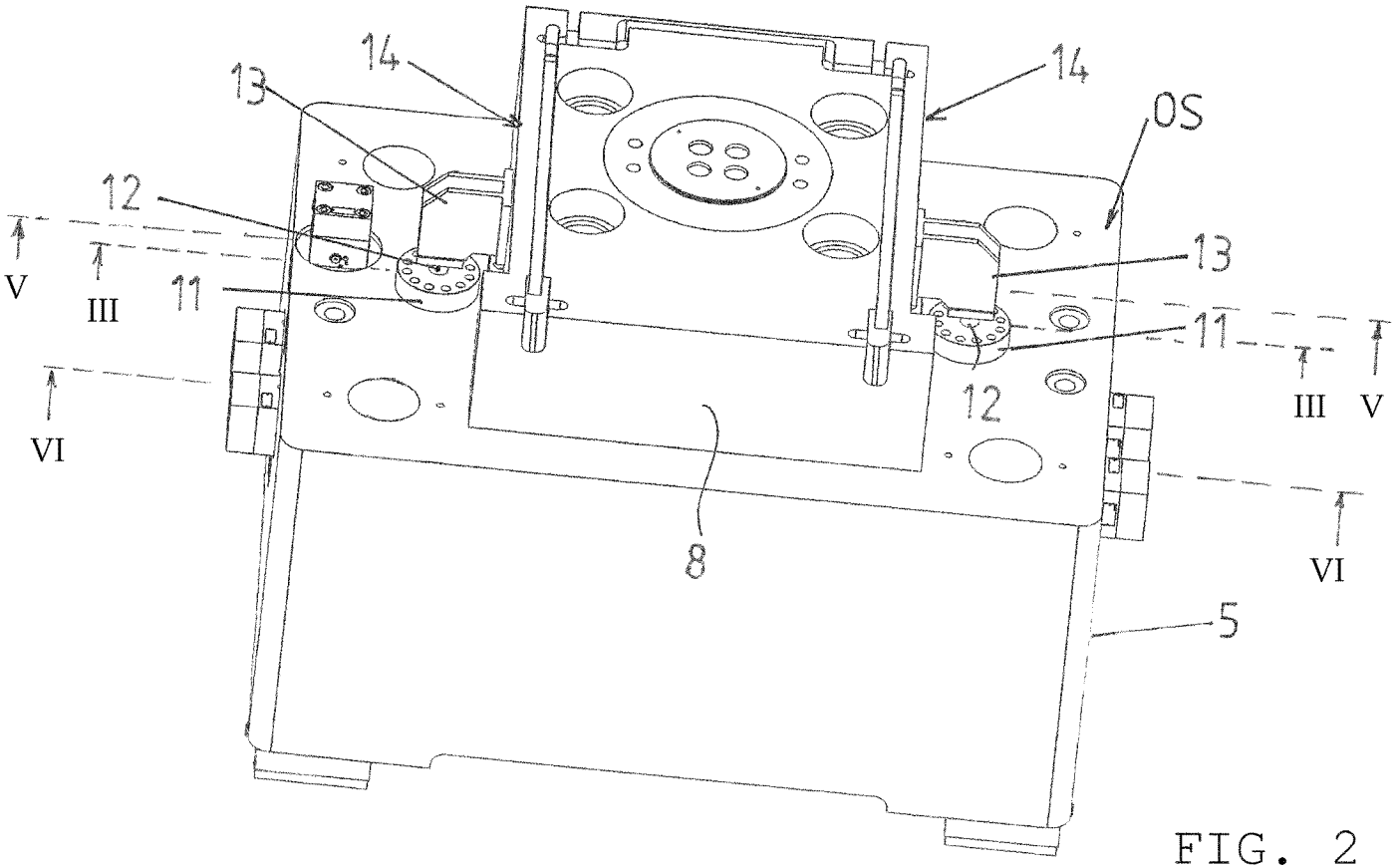
FIG. 2 shows a perspective view of the base together with the table.
Figure 3:
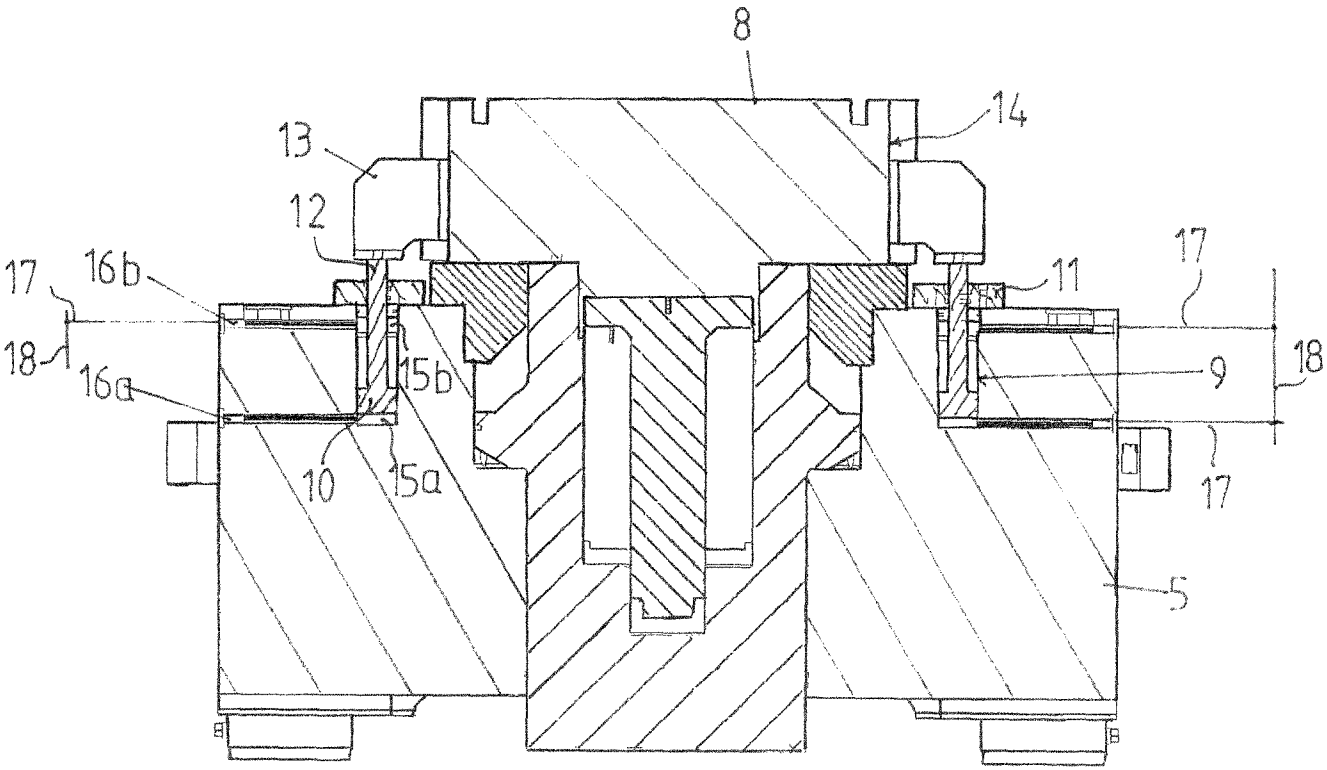
FIG. 3 shows a section of the base together with the table along line III-Ill from FIG. 2.

As is illustrated in FIGS. 2 and 3, a table 8, which supports the bottom tool part (not shown in more detail), is disposed on the upper face OS of the base 5. Approximately centrally, two opposing fast stroke cylinders 9 oriented parallel to the stroke axis HU are introduced into the base 5, which each receive a double-acting fast stroke piston 10 and are closed by a cover 11. The fast stroke piston 10 includes a piston rod 12, which extends through the cover 11 and is connected to a carrier 13, which is attached to a side wall 14 of the table 8. The fast stroke piston 10 partitions a first and a second pressure chamber 15*a* and 15*b* (see also FIG. 3) in the fast stroke cylinder 9. The pressure chamber 15*a* and the pressure chamber 15*b* are connected via a channel 16*a* and 16*b*, respectively, which are introduced in the base 5, to the hydraulic tube 17 of the hydraulic system 18 so as to be acted upon by hydraulic fluid having a predefined pressure, such that it is possible to vertically displace the table 8 during the rapid approach in the direction of the head piece 4.

Figure 4A:
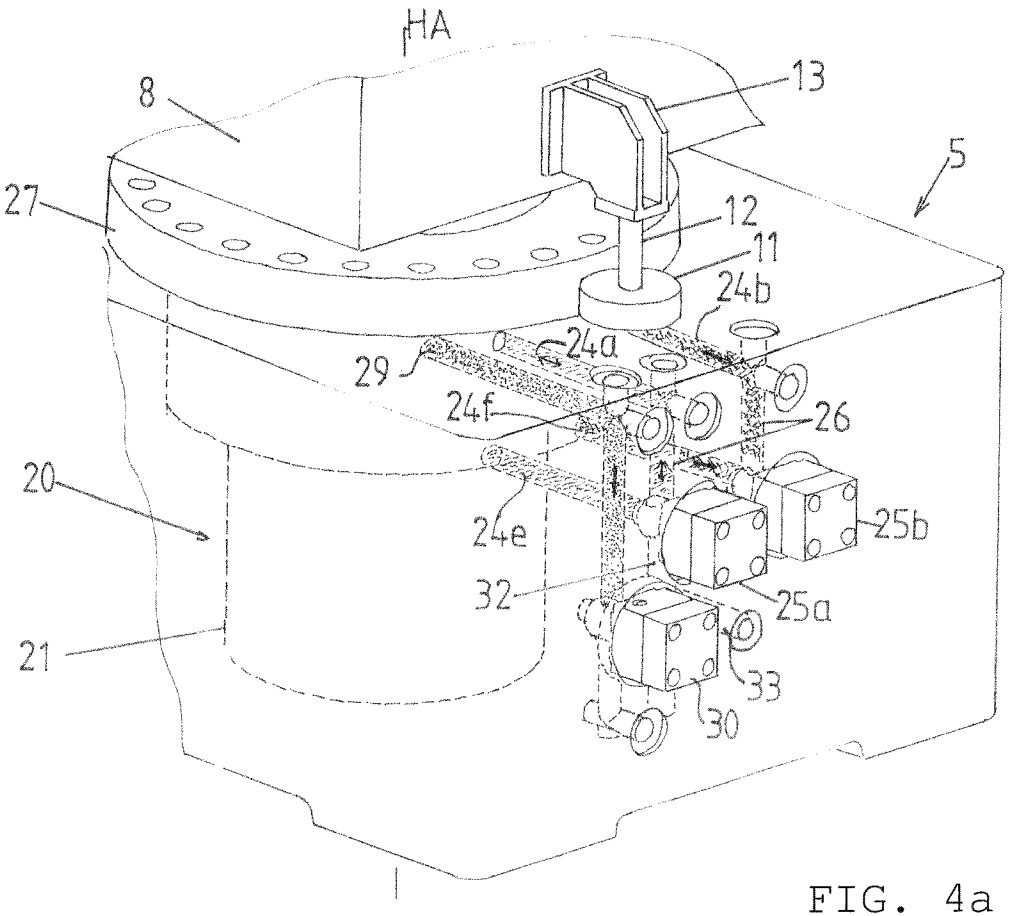
FIGS. 4*a* and 4*b* each show a perspective view of the base, with an illustration of the locations of the fluid channels and of the vent channel.
Figure 4B:
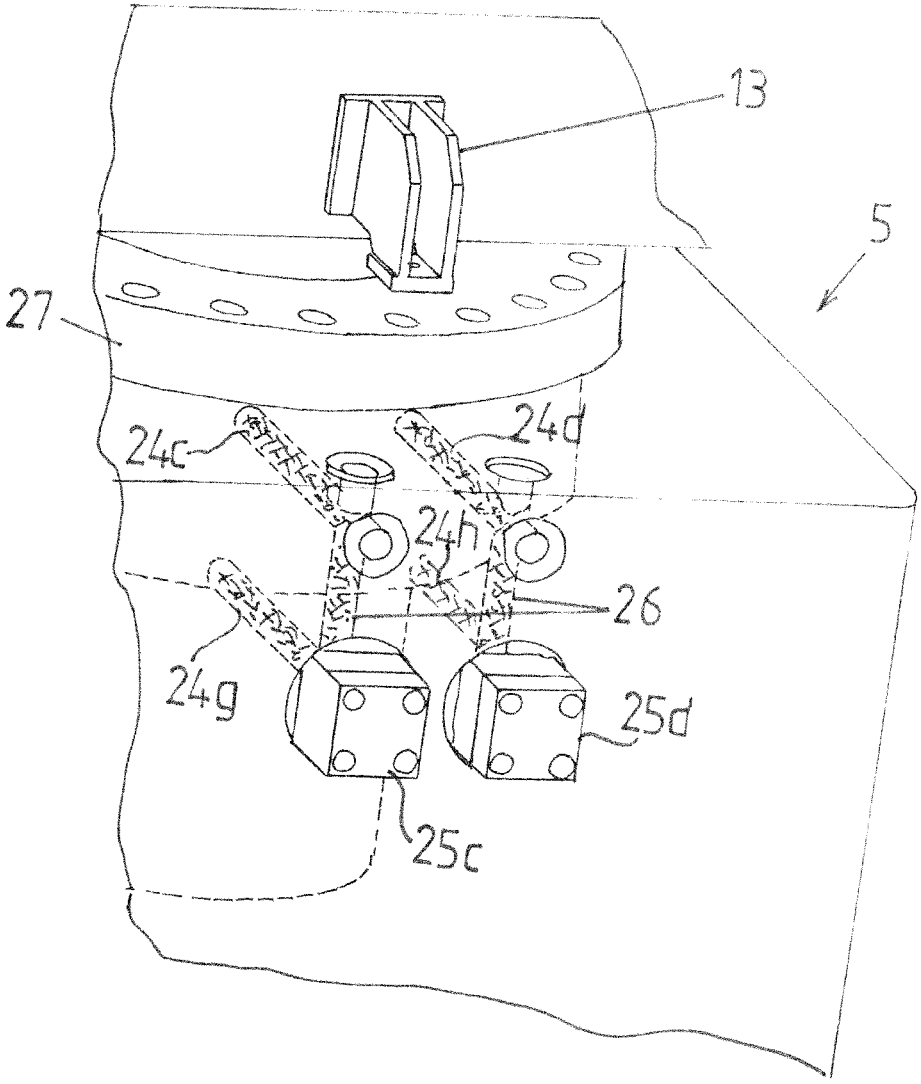
Figure 5:
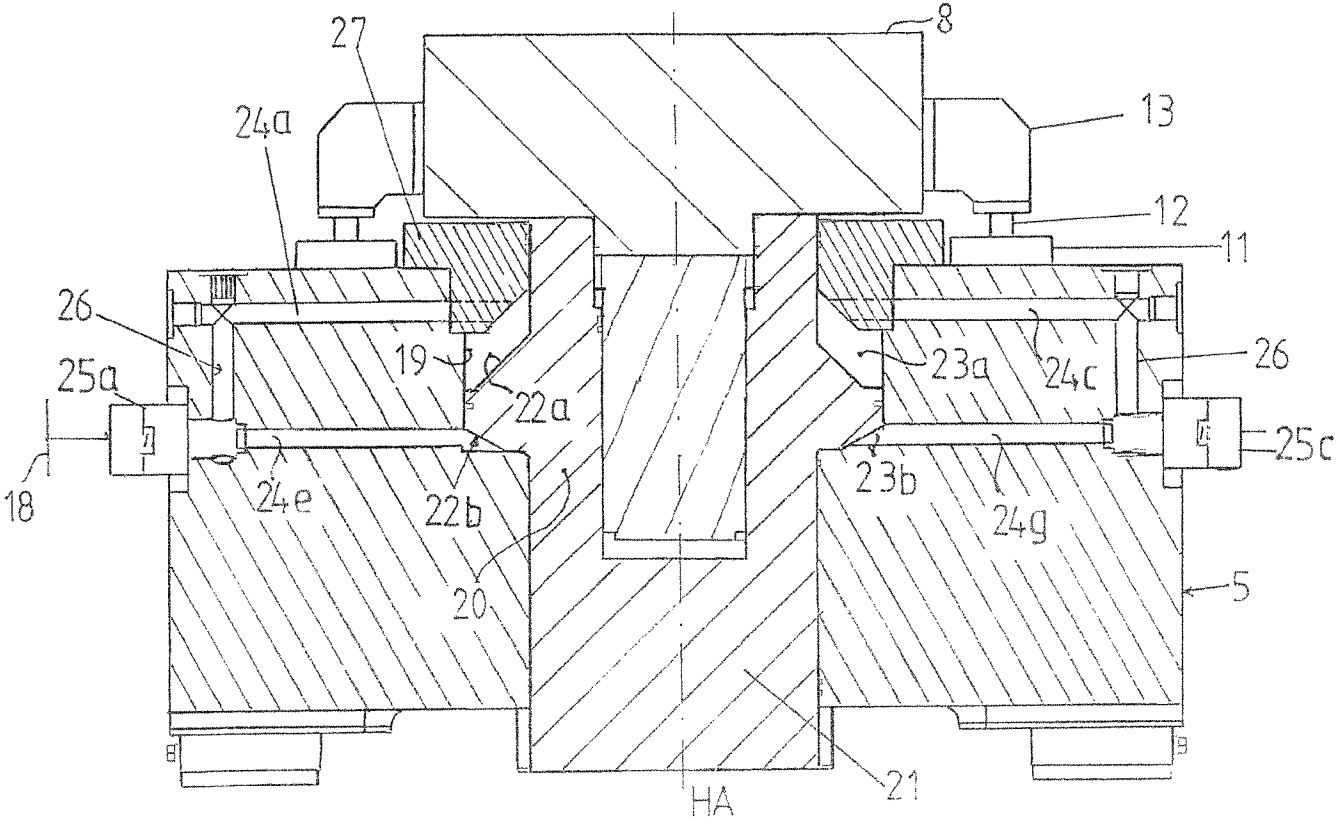
FIG. 5 shows a section of the base together with the table along line V-V from FIG. 2.

FIGS. 4*a*, 4*b* and 5 show the spatial locations of the fluid channels 24*a* to 24*h* and of the vent channel 29 in the base 5 in a transparent representation and in a section along line V-V from FIG. 2.

A main cylinder chamber 19 is formed in the base 5, the axis HA of which is located on the stroke axis HU of the fine blanking press and receives the double-acting main piston 20. The main piston 20 has a cylindrical shaft 21, which comprises disk-like working surfaces 22*a* and 22*b* protruding perpendicularly to the axis HA, which partition the main cylinder chamber 19 into a first (top) pressure chamber 23*a* and a second (bottom) pressure chamber 23*b* having a low stroke height, so that the base 5 is compact and has a low height.

The main cylinder chamber 19, and thus the pressure chamber 23*a*, is closed in a pressure-tight manner by a cover 27, which is attached to the base 5.

The first (top) fluid channels 24*a*, 24*b*, 24*c* and 24*d* and the second (bottom) fluid channels 24*e*, 24*f*, 24*g* and 24*h*, which are located in the base 5 on top of one another perpendicularly to the stroke axis HU corresponding to the heights of the pressure chambers 23*a* and 23*b*, lead into the pressure chambers 23*a* and 23*b* of the main piston 20. The fluid channels 24*a* to 24*d* are connected to the fluid channels 24*e* to 24*h* by a respective bypass channel 26.

Furthermore, a pressure-controlled proportional valve 25*a*, 25*b*, 25*c* and 25*d* is inserted as a built-in valve into each of the second (bottom) fluid channels 24*e* to 24*h*, the valve closing the respective bypass channel 26 when the second pressure chamber 23*b* is acted upon by hydraulic fluid having a predefined pressure from the hydraulic system 18.

During the rapid approach, the main piston 20 carries out a corresponding stroke movement between lower dead point UT and upper dead point OT and, when the proportional valve 25*a* to 25*d* is open, displaces the hydraulic fluid present in the first (top) pressure chamber 23*a* via the first (top) fluid channels 24*a* to 24*d*, the bypass channels 26, and the second (bottom) fluid channels 24*e* to 24*h* into the second (bottom) pressure chamber 23*b*. The first (top) pressure chamber 23*a*, the first (bottom) fluid channels 24*a* to 24*d*, the bypass channels 26, the bottom fluid channels 24*e* to 24*h*, and the second (bottom) pressure chamber 24*b* thus form a closed hydraulic system, which can be opened or closed, depending on the position of the proportional valves 25*a* to 25*d*, so that the first (top) pressure chamber 23*a* and the second (bottom) pressure chamber 23*b* are substantially depressurized, and the hydraulic fluid is displaced into the second (bottom) pressure chamber 23*b* of the main piston 20, and a fluid column can be created in the movement direction BR of the fast stroke piston 10 during the rapid approach.

Figure 6:
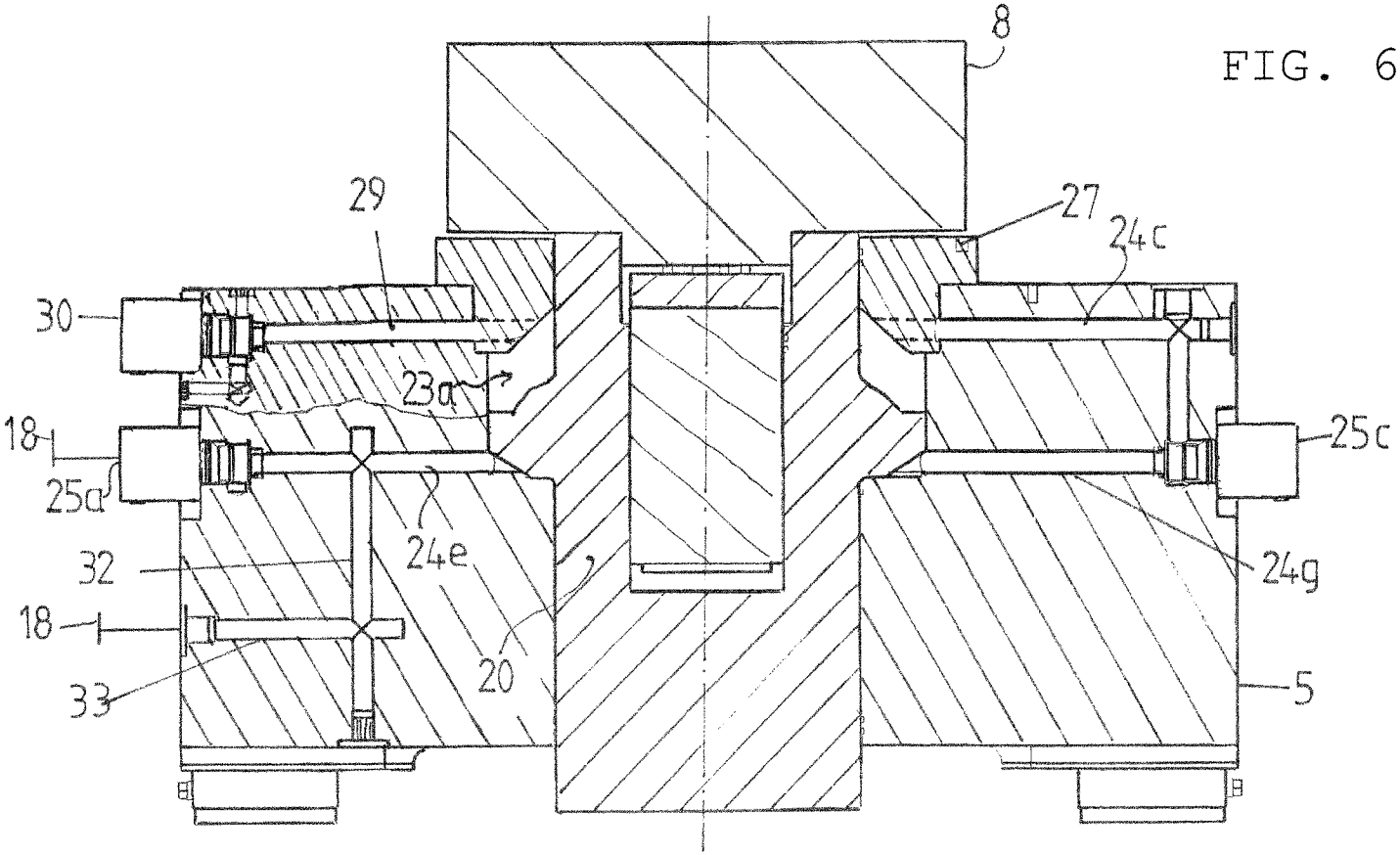
FIG. 6 shows a section of the base together with the table along line VI-VI from FIG. 2.

When the fast stroke piston reaches the target position thereof during the rapid approach, the proportional valves 25*a* to 25*d* switch into the closed position, and the power stroke begins, which is described in more detail hereafter based on FIG. 6.

FIG. 6 shows the base 5 in a further section along line VI-VI from FIG. 2, which illustrates the locations of the fluid channel 24*e* and of the vent channel 29 (see also FIG. 4*a*).

The vent channel 29 opens into the first pressure chamber 23*a* of the main piston 20, and the fluid channel 24*e* opens into the second pressure chamber 23*b*, which are disposed on top of one another perpendicular to the stroke axis HU corresponding to the heights of the pressure chambers 23*a* and 23*b*.

A tank valve 30 for opening and closing the vent channel 29 is inserted into the vent channel 29 as a built-in valve, which is in the open position when, during the power stroke, the hydraulic fluid present in the pressure chamber 23*a* is displaced into the collection tank 44.

The fluid channel 24*e* is connected to a supply channel 32, which is situated parallel to the stroke axis HU in the base 5, and to a branch channel 33, which branches off this supply channel and via which the hydraulic system 18, which is not shown in detail, is connected.

Figure 7A:
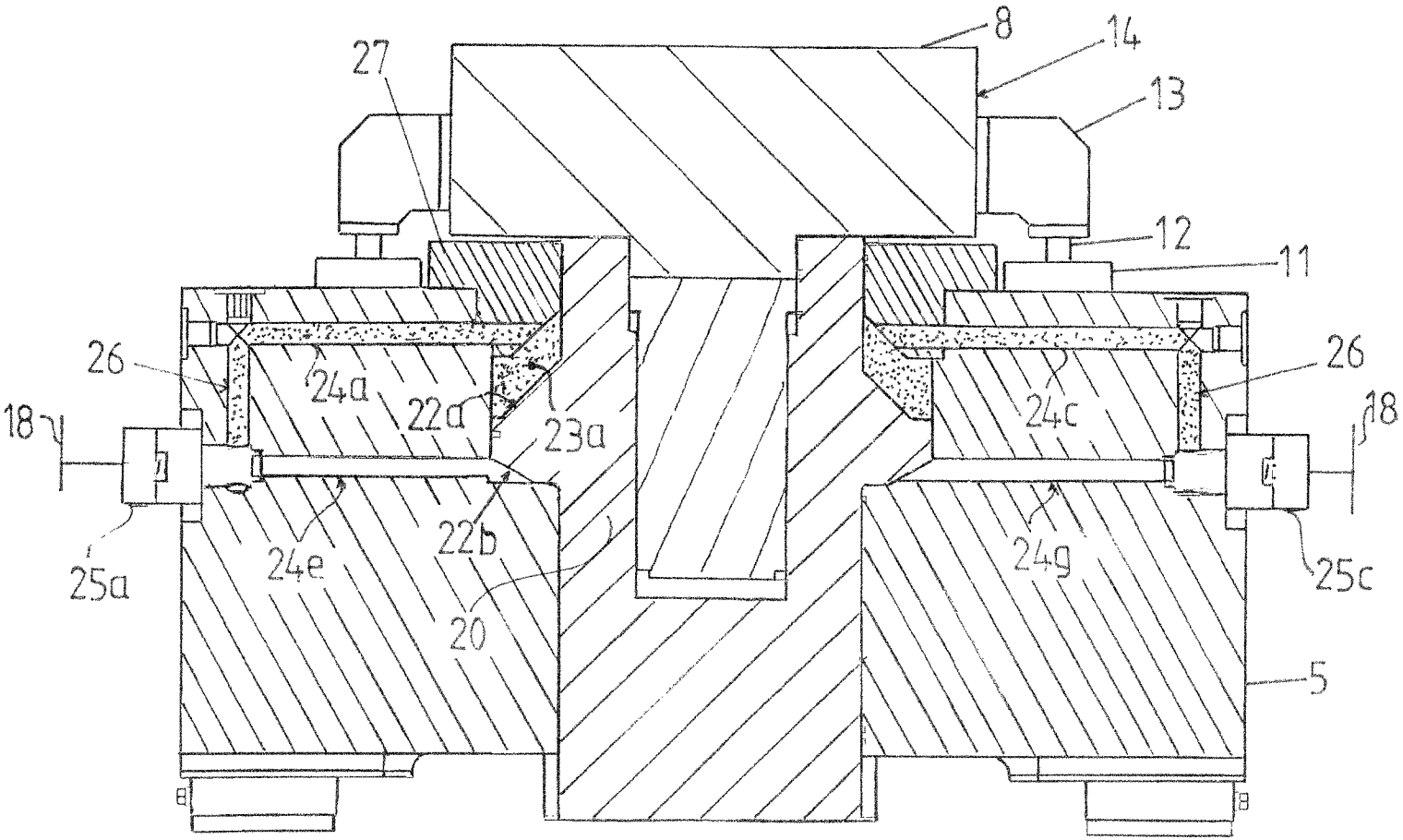
FIGS. 7*a* and 7*b* show schematic representations of the displacement of the hydraulic fluid from one pressure chamber into the other pressure chamber of the main piston as a function of the stroke position of the fast stroke piston.
Figure 7B:
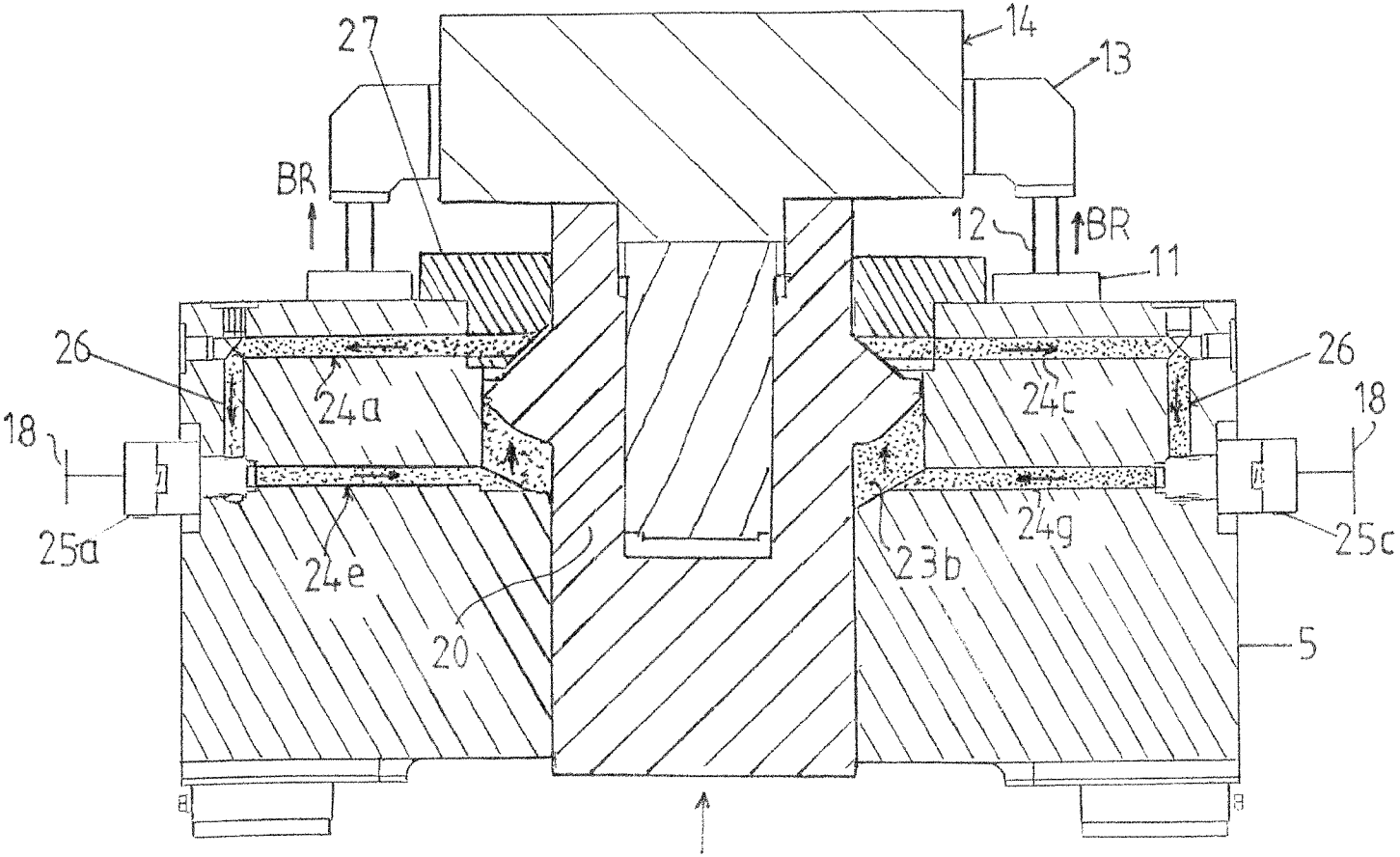

FIGS. 7*a* and 7*b* schematically show the displacement of the hydraulic fluid from the first (top) pressure chamber 23*a* into the second (bottom) pressure chamber 23*b* during the stroke movement of the main piston 20 in the direction of TDC during the rapid approach, based on the example of fluid channels 24*a* and 24*b*.

The main piston 20, together with the table 8, carries out a stroke in the direction of OT due to the fast stroke piston 10. As a result of the upward motion of the working surface 22*a* of the main piston 20, the hydraulic fluid present in the first (top) pressure chamber 23*a* is displaced from the first (top) pressure chamber 23*a* when the tank valve 30 is closed, and when the proportional valve 25*a* is open, the fluid reaches the bottom pressure chamber 23*b* via the first fluid channel 24*a*, the bypass channel 26, and the second fluid channel 24*e*. The displacement is indicated in FIG. 7*b* by an arrow. In FIG. 7*b*, the fast stroke piston 10 has reached the top target position thereof, the proportional valve 25*a* closes, the proportional valve 30 opens, and the power stroke begins.

Figure 8:
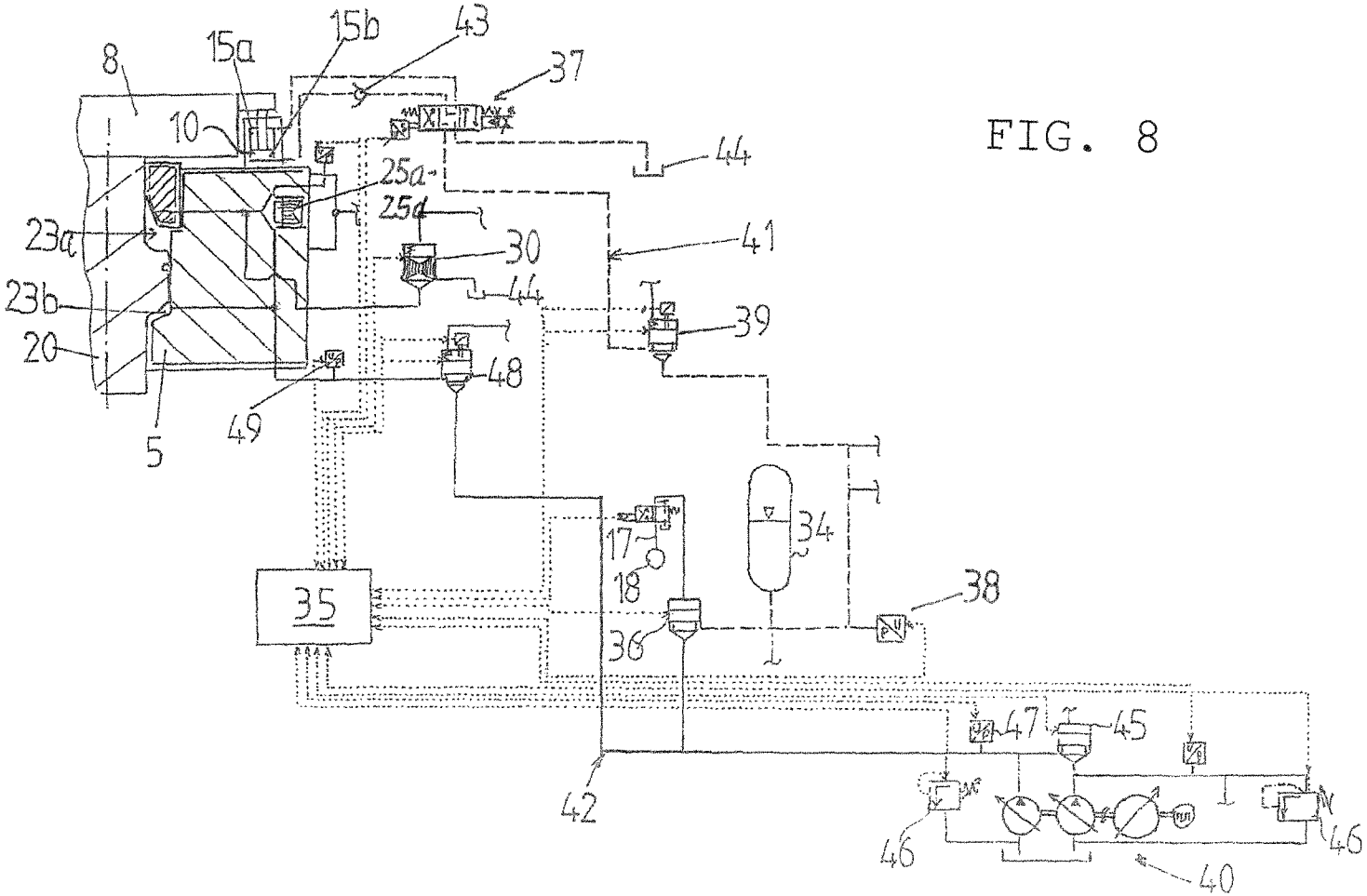
FIG. 8 shows a schematic representation of the flow of the method according to the invention.

The flow of the method according to the invention will be described based on FIG. 8, which shows the hydraulic branch 41 for the rapid approach and the hydraulic branch 42 for the power stroke of the main piston 20.

The hydraulic branch 41 includes a high pressure accumulator 34 for hydraulic fluid, a logic proportional valve 36, which is activated by the central control unit 35 and which is connected to the hydraulic system 18 via the hydraulic tube 17 and sets the pressure level in the high pressure accumulator 34, a pressure pick-up 38, a safety valve 39, a 4/3-way proportional valve 37, which activates or deactivates the supply of the hydraulic fluid to the pressure chambers 15*a* or 15*b* depending on the position of the fast stroke piston 10 in the fast stroke cylinder 9, a double check valve 43 associated with the bottom pressure chamber 15*b*, and the pressure chambers 15*a* and 15*b* of the fast stroke pistons 10.

The pressure chambers 15*a* and 15*b* of the fast stroke piston 10 are supplied via the shared high pressure accumulator 34 with hydraulic fluid having an appropriate pressure, which is set by appropriate activation of the valve 36 by the central control unit 35 as an accumulator charge.

As soon as the fast stroke piston has reached the top target position thereof during the rapid approach, the proportional valve 25*a* installed in the fluid channel 24*e* closes, the tank valve 30 opens, and the 4/3-way proportional valve 37 switches to a center position.

The fluid channel 24*e* then assumes the function of a power stroke channel, in which hydraulic fluid having a predefined pressure is supplied to the second pressure chamber 23*b*.

The hydraulic branch 42 for the power stroke comprises a hydraulic pump unit 40, with which at least one proportional valve 45 for setting the delivery volume, at least one pressure control valve 46 for limiting the pressure of the delivery flow, and at least one pressure pick-up 47 for pressure detection for limiting the power and forwarding the pressure value to the central control unit 35 for activation of the pressure control valve 46 are associated, a safety valve 48, which activates or deactivates the supply of hydraulic fluid conducted to the bottom pressure chamber 23*b*, a pressure pick-up 49 for ascertaining the pressure value, which is forwarded to the central control unit for activation of the pressure control valve 46, and the pressure chambers 23*a* and 23*b* of the main piston 20.

Once the main piston 20 has reached the upper dead point OT thereof, the power stroke is ended. The safety valve 48 for the power stroke and the tank valve 30 close, at the same time the proportional valve 25*a* for the fluid channel 24*e* and the proportional valve 37 for supplying hydraulic fluid from the high pressure accumulator 34 open, and the rapid approach starts, in which the top pressure chamber 15*a* of the fast stroke piston 10 is acted upon by hydraulic fluid having a predefined pressure, so that the main piston 20, together with the table 8, is lowered, and reaches the bottom target position thereof. The 4/3-way proportional valve 37 switches, so that the bottom pressure chamber 15*b* can be acted upon by hydraulic fluid, and the fast stroke piston 10 is moved in the direction of the top target position thereof.

As soon as the fast stroke piston has reached the top target position thereof, another power stroke starts.

The invention claimed is:

1. A hydraulically driven fine blanking press, comprising a base; a main cylinder chamber formed in the base; a main piston disposed in the main cylinder chamber so as to carry out a stroke movement of the main piston along a vertical stroke axis between a lower dead point and an upper dead point, the piston including a radially outwardly extending protrusion having upper and lower faces; an upper and a lower hydraulic pressure chamber formed in the base, each of the upper and lower hydraulic pressure chambers being comprised of interior faces of the main cylinder chamber and exterior faces of the main piston including the protrusion and wherein the upper hydraulic pressure chamber includes the upper face of the protrusion and the lower hydraulic pressure chamber includes the lower face of the protrusion whereby the upper hydraulic pressure chamber acts on the upper face of the protrusion to push the main piston toward the lower dead point and the lower hydraulic pressure chamber acts on the lower face of the protrusion to push the main piston toward the upper dead point; a table supported by the main piston; respective fast stroke cylinders formed in the base and respective double-acting fast stroke pistons each received in a respective one of the fast stroke cylinders and each fast stroke piston comprising partitioning structure having an upper surface and a lower surface, the partitioning structure partitioning the fast stroke cylinder in which the fast stroke piston is received into an upper hydraulic pressure chamber which acts on the upper surface of the partitioning structure of the fast stroke piston to push the fast stroke piston downwards and a lower hydraulic pressure chamber which acts on the lower surface of the partitioning structure of the fast stroke piston to push the fast stroke piston upwards to a target position; respective piston rods each connecting to the table; an internal hydraulic system formed in the base; a hydraulic system external of the base and connected to the internal hydraulic system and including a hydraulic pump, a hydraulic fluid collection tank provided with a tank valve, a high pressure accumulator and a central control unit that sets the hydraulic fluid to a predetermined working pressure; the internal hydraulic system comprising a hydraulic fluid upper channel connecting with the upper hydraulic pressure chamber for the main piston, a hydraulic fluid lower channel connecting with the lower hydraulic pressure chamber for the main piston, and a hydraulic fluid bypass channel connecting between the hydraulic fluid upper channel and the hydraulic fluid lower channel; a pressure-controlled proportional valve connecting with the external hydraulic system and with the hydraulic fluid lower channel and the hydraulic fluid bypass channel; a vent channel connecting with the upper hydraulic pressure chamber of the main piston and, via the tank valve, with the hydraulic fluid collection tank; a hydraulic fluid supply channel connecting the hydraulic fluid lower channel, via a hydraulic fluid branch channel branching from the hydraulic fluid supply channel, to the external hydraulic system; and a hydraulic fluid branch channel branching from the hydraulic fluid supply channel and connected to the external hydraulic system, whereby the fine blanking press is controlled by the internal hydraulic system as follows: the fast stroke piston is pushed upwards toward its target position by hydraulic pressure in the lower hydraulic pressure chamber for the fast stroke piston while the pressure-controlled proportional valve is open and the main piston carries out a stroke movement from the lower dead point toward but not reaching the upper dead point during which the hydraulic fluid is displaced from the upper hydraulic pressure chamber for the main piston to the lower hydraulic pressure chamber for the main piston through the hydraulic fluid upper channel, the hydraulic fluid lower channel and the hydraulic fluid bypass channel; and when the fast stroke piston reaches its target position, the pressure-controlled proportional valve closes and the main piston is caused to effect a power stroke to the upper dead point by the hydraulic fluid being supplied through the hydraulic fluid supply channel and the hydraulic fluid bypass channel to the lower hydraulic pressure chamber for the main piston and being discharged from the upper hydraulic pressure chamber for the main piston to the hydraulic fluid collection tank via the tank valve.

2. The hydraulically driven fine blanking press according to claim 1, wherein the external hydraulic system further comprises a line through which the hydraulic fluid is supplied to the hydraulic fluid supply channel, a safety valve in said line, a pressure pick-up detecting pressure of the hydraulic fluid supplied to the hydraulic fluid supply channel, and a pressure control valve limiting pressure of the hydraulic fluid delivered by the hydraulic pump.

3. The hydraulically driven fine blanking press according to claim 1, wherein the tank valve is a pressure-controlled valve.

4. The hydraulically driven fine blanking press according to claim 1, wherein the lower surface of the partitioning structure of each of the fast stroke pistons is larger than the upper surface of the partitioning structure of that fast stroke piston, the internal hydraulic system further comprises upper hydraulic fluid channels each communicating with the upper hydraulic pressure chamber for a respective one of the fast stroke pistons and respective lower hydraulic fluid channels each communicating with the lower hydraulic pressure chamber for a respective one of the fast stroke pistons, the external hydraulic system further comprises a branch comprising a line connected, through the lower hydraulic fluid channel, to the lower hydraulic pressure chamber for each of the fast stroke pistons, the branch further comprising a double check valve, a 4/3-way proportional valve, a safety valve and the high pressure accumulator; and the upper hydraulic fluid pressure chamber for each of the fast stroke pistons being connected, via the 4/3-way proportional valve, to the hydraulic fluid collection tank.

5. The hydraulically driven fine blanking press according to claim 1, wherein the fast stroke pistons and cylinders are two in number and a stroke axis of each of the fast stroke pistons is parallel to the stroke axis of the main piston, each of two opposed side walls of the table has a respective carrier attached thereto and the piston rod of each respective one of the pistons is attached to a respective one of the carriers.

6. The hydraulically driven fine blanking press according to claim 1, further comprising for each respective one of the fast stroke cylinders a respective cover which closes the respective fast stroke cylinder in a pressure-tight manner and through which the fast stroke piston for that cylinder extends.

7. The hydraulically driven fine blanking press according to claim 1, wherein the external hydraulic system further comprises another proportional valve, a pressure pickup detecting pressure of the hydraulic fluid delivered by the hydraulic pump and operatively connected to the other proportional valve, and a pressure control valve limiting pressure of the hydraulic fluid delivered by the hydraulic pump.

8. The hydraulically driven fine blanking press according to claim 1, further comprising a displacement measuring unit detecting displacement of the main piston along the vertical stroke axis of the main piston.

9. A method for controlling a hydraulically driven fine blanking press comprising a base; a main cylinder chamber formed in the base; a main piston disposed in the main cylinder chamber so as to carry out a stroke movement of the main piston along a vertical stroke axis between a lower dead point and an upper dead point, the piston including a radially outwardly extending protrusion having upper and lower faces; an upper and a lower hydraulic pressure chamber formed in the base, each of the upper and lower hydraulic pressure chambers being comprised of interior faces of the main cylinder chamber and exterior faces of the main piston including the protrusion and wherein the upper hydraulic pressure chamber includes the upper face of the protrusion and the lower hydraulic pressure chamber includes the lower face of the protrusion whereby the upper hydraulic pressure chamber acts on the upper face of the protrusion to push the main piston toward the lower dead point and the lower hydraulic pressure chamber acts on the lower face of the protrusion to push the main piston toward the upper dead point; a table supported by the main piston; respective fast stroke cylinders formed in the base and respective double-acting fast stroke pistons each received in a respective one of the fast stroke cylinders and each fast stroke piston comprising partitioning structure having an upper surface and a lower surface, the partitioning structure partitioning the fast stroke cylinder in which that fast stroke piston is received into an upper hydraulic pressure chamber which acts on the upper surface of the partitioning structure of the fast stroke piston to push the fast stroke piston downwards and a lower hydraulic pressure chamber which acts on the lower surface of the partitioning structure of the fast stroke piston to push the fast stroke piston upwards to a target position; respective piston rods each connecting to the table; an internal hydraulic system formed in the base; a hydraulic system external of the base and connected to the internal hydraulic system and including a hydraulic pump, a hydraulic fluid collection tank provided with a tank valve, a high pressure accumulator and a central control unit that sets the hydraulic fluid to a predetermined working pressure; the internal hydraulic system comprising a hydraulic fluid upper channel connecting with the upper hydraulic pressure chamber for the main piston, a hydraulic fluid lower channel connecting with the lower hydraulic pressure chamber for the main piston, and a hydraulic fluid bypass channel connecting between the hydraulic fluid upper channel and the hydraulic fluid lower channel; a pressure-controlled proportional valve connecting with the external hydraulic system and with the hydraulic fluid lower channel and the hydraulic fluid bypass channel; a vent channel connecting with the upper hydraulic pressure chamber of the main piston and, via the tank valve, with the hydraulic fluid collection tank; a hydraulic fluid supply channel connecting the hydraulic fluid lower channel, via a hydraulic fluid branch channel branching from the hydraulic fluid supply channel, to the external hydraulic system; and a hydraulic fluid branch channel branching from the hydraulic fluid supply channel and connected to the external hydraulic system, the method comprising:

effecting a rapid approach stroke of the main piston with the fast stroke pistons from the lower dead point to a target point approaching but not reaching the upper dead point by:

feeding the pressure chambers for the fast stroke pistons from the high pressure accumulator, the high pressure accumulator being permanently set to a working pressure; and isolating the upper and lower hydraulic fluid channels and the bypass channel from the external hydraulic system by closing the pressure controlled proportional valve so that the hydraulic fluid is displaced from the upper pressure chamber into the lower pressure chamber in a substantially depressurized state; and after the rapid approach stroke, effecting a power stroke of the main piston from the target point to the upper dead point to effect blanking.

10. The method for controlling the hydraulically driven fine blanking press according to claim 9, wherein the lower surface of the partitioning structure of each of the fast stroke pistons is larger than the upper surface of the partitioning structure of that fast stroke piston, the internal hydraulic system further comprises upper hydraulic fluid channels each communicating with the upper hydraulic pressure chamber for a respective one of the fast stroke pistons and lower hydraulic fluid channels each communicating with the lower hydraulic pressure chamber for a respective one of the fast stroke pistons, the external hydraulic system further comprises a branch comprising a line connected, through the lower hydraulic fluid channel, to the lower hydraulic pressure chamber for each of the fast stroke pistons, the branch further comprising a double check valve, a 4/3-way proportional valve, a safety valve and the high pressure accumulator; and the upper hydraulic fluid pressure chamber for each of the fast stroke pistons being connected, via the 4/3-way proportional valve, to the hydraulic fluid collection tank, the method further comprising:

setting, with the central control unit, working pressure in the lower hydraulic pressure chamber for each of the fast stroke pistons via the double check valve, the 4/3-way proportional valve, the safety valve, and the high pressure accumulator; and setting, with the central control unit, working pressure in the upper hydraulic pressure chamber for each of the fast stroke pistons via the 4/3-way proportional valve.

11. The method for controlling the hydraulically driven fine blanking press according to claim 10, wherein the external hydraulic system further comprises a line through which the hydraulic fluid is supplied to the hydraulic fluid supply channel, a safety valve in said line, a pressure pick-up detecting pressure of the hydraulic fluid supplied to the hydraulic fluid supply channel, a pressure control valve limiting pressure of the hydraulic fluid delivered by the hydraulic pump, and another pressure-controlled proportional valve, the method further comprising, during the working stroke:

setting, with the central control unit, working pressure in the lower hydraulic pressure chamber for the main piston via the safety valve, the pressure pick-up, the pressure control valve, the other pressure-controlled proportional valve and the hydraulic pump; and setting, with the central control unit, working pressure in the upper hydraulic pressure chamber for the main piston via the tank valve and the collection tank.

12. The method for controlling the hydraulically driven fine blanking press according to claim 10, wherein the hydraulically driven fine blanking press further comprises a displacement measuring unit detecting displacement of the main piston along the vertical stroke axis of the main pisco the method further comprising:

setting, with the central control unit, via the displacement measuring unit, the upper dead point of the stroke of the main piston; and as the main piston approaches but before the main piston reaches the upper dead point, reducing volumetric rate of delivery of the hydraulic fluid by the hydraulic pump and, via the tank valve, generating a counter pressure in the upper hydraulic pressure chamber for the main piston.

* * * * *